US008853580B2

(12) United States Patent
Chen

(10) Patent No.: US 8,853,580 B2
(45) Date of Patent: Oct. 7, 2014

(54) KEY STRUCTURE OF KEYBOARD DEVICE

(75) Inventor: Bo-An Chen, Taipei (TW)

(73) Assignee: Primax Electronics Ltd., Taipei (TW)

( * ) Notice: Subject to any disclaimer, the term of this patent is extended or adjusted under 35 U.S.C. 154(b) by 526 days.

(21) Appl. No.: 13/045,224

(22) Filed: Mar. 10, 2011

(65) Prior Publication Data

US 2012/0193202 A1 Aug. 2, 2012

(30) Foreign Application Priority Data

Jan. 28, 2011 (TW) ..... 100103267 A

(51) Int. Cl.
*H01H 13/70* (2006.01)
*H01H 3/12* (2006.01)

(52) U.S. Cl.
CPC ..... *H01H 3/125* (2013.01); *H01H 2229/034* (2013.01)
USPC ..... 200/344

(58) Field of Classification Search
CPC ..... H01H 13/125; H01H 13/02; H01H 13/14; H01H 13/705; G06F 3/0202; G06F 3/0238
USPC ..... 200/5 A, 517, 344; 400/490–496
See application file for complete search history.

(56) References Cited

U.S. PATENT DOCUMENTS

| | | | | | |
|---|---|---|---|---|---|
| 5,630,501 | A * | 5/1997 | Tsay | ..... | 200/344 |
| 5,767,468 | A * | 6/1998 | Tsai | ..... | 200/344 |
| 5,829,579 | A * | 11/1998 | Tsai | ..... | 200/344 |
| 5,842,798 | A * | 12/1998 | Su | ..... | 400/491.2 |
| 5,947,616 | A * | 9/1999 | Liang | ..... | 400/491.2 |
| 6,040,540 | A * | 3/2000 | Tsai et al. | ..... | 200/344 |
| 6,194,677 | B1 * | 2/2001 | Li | ..... | 200/344 |
| 7,138,587 | B2 * | 11/2006 | Nishino et al. | ..... | 200/5 A |
| 7,183,512 | B2 * | 2/2007 | Lee et al. | ..... | 200/344 |
| 7,893,376 | B2 * | 2/2011 | Chen | ..... | 200/344 |

* cited by examiner

*Primary Examiner* — Renee Luebke
*Assistant Examiner* — Lheiren Mae Caroc
(74) *Attorney, Agent, or Firm* — Tracy M. Helms; Apex Juris, pllc

(57) ABSTRACT

A key structure of a keyboard device includes a scissors-type connecting member and a base plate. The base plate includes a base plate fixing hook, a base plate sliding hook and a stopping structure. The entrance of the base plate fixing hook and the entrance of the base plate sliding hook face the same side. Due to the configurations of the base plate, the scissors-type connecting member can be easily assembled within the base plate fixing hook and the base plate sliding hook. In addition, the scissors-type connecting member can be fixed on the base plate by using the base plate fixing hook and the stopping structure.

14 Claims, 8 Drawing Sheets

KEY STRUCTURE OF KEYBOARD DEVICE

CROSS-REFERENCES TO RELATED APPLICATIONS

This non-provisional application claims priority under 35 U.S.C. §119(a) to Patent Application No(s). 100103267 filed in Taiwan, R.O.C. on Jan. 28, 2011, the entire contents of which are hereby incorporated by reference.

FIELD OF THE INVENTION

The present invention relates to a key structure, and more particularly to a key structure of a keyboard device.

BACKGROUND OF THE INVENTION

Generally, the common input device of a computer system includes for example a mouse device, a keyboard device, a trackball device, and the like. Via the keyboard device, the user may directly input characters and commands into the computer system. As a consequence, most users and most manufacturers of the input devices pay much attention to the development of the keyboard devices.

Hereinafter, the configurations and the functions of a conventional keyboard device will be illustrated with reference to FIG. 1. FIG. 1 is a schematic view illustrating the outward appearance of a conventional keyboard device. As shown in FIG. 1, plural keys 10 are installed on the surface of the conventional keyboard device 1. These keys 10 are classified into some types, e.g. ordinary keys, numeric keys and function keys. When one or more keys 10 are depressed by the user's fingers, a corresponding signal is issued to the computer, and thus the computer executes a function corresponding to the depressed key or keys. For example, when the ordinary keys are depressed, corresponding English letters or symbols are inputted into the computer system. In addition, the function keys (e.g. F1~F12) can be programmed to cause corresponding application programs to provide certain functions.

Hereinafter, the key structure of the conventional keyboard device will be illustrated with reference to FIG. 2. FIG. 2 is a schematic side view illustrating a key structure of a conventional keyboard device. As shown in FIG. 2, the key structure 2 of the conventional keyboard device comprises a base plate 20, a scissors-type connecting member 21, a keycap 22, an elastic element 23 and a membrane switch 24. The membrane switch 24 is disposed on the base plate 20. The scissors-type connecting member 21 is arranged between the base plate 20 and the keycap 22. The elastic element 23 is disposed on the membrane switch 24, and in contact with the keycap 22. The elastic element 23 is made of a rubbery material. The base plate 20 comprises a base plate fixing structure 201 and a base plate sliding hook 202. The base plate fixing structure 201 comprises a base plate fixing hook 2011 and a stopping structure 2012. The base plate fixing structure 201 is arranged at a second side 204 of the base plate 20. An entrance 2011A of the base plate fixing hook 2011 faces the second side 204 of the base plate 20. The base plate sliding hook 202 is arranged at a first side 203 of the base plate 20. An entrance 2021 of the base plate sliding hook 202 faces the first side 203 of the base plate 20. The keycap 22 comprises a keycap fixing structure 221 and a keycap sliding hook 222. The keycap fixing structure 221 is arranged at a second side 224 of the keycap 22. The keycap sliding hook 222 is arranged at a first side 223 of the keycap 22.

The scissors-type connecting member 21 comprises a first frame 211 and a second frame 212. A first end 2111 of the first frame 211 is connected with the base plate fixing structure 201. In addition, the first end 2111 of the first frame 211 is fixed between the base plate fixing hook 2011 and the stopping structure 2012. A second end 2112 of the first frame 211 is connected with the keycap sliding hook 222. In addition, the second end 2112 of the first frame 211 may be slid in the keycap sliding hook 222. A first end 2121 of the second frame 212 is connected with the keycap fixing structure 221. In addition, the first end 2121 of the second frame 212 is fixed in the keycap fixing structure 221. A second end 2122 of the second frame 212 is connected with the base plate sliding hook 202. In addition, the second end 2122 of the second frame 212 may be slid in the base plate sliding hook 202.

When the key structure 2 is depressed, the keycap 22 is moved downwardly to push against the elastic element 23, and thus the membrane switch 24 is triggered by the elastic element 23 to generate a key signal. At the same time, the second end 2112 of the first frame 211 and the second end 2122 of the second frame 212 of the scissors-type connecting member 21 are moved within the keycap sliding hook 222 and the base plate sliding hook 202, respectively. Under this circumstance, the scissors-type connecting member 21 is switched from an open-scissors state to a folded state. Whereas, when the depressing force exerted on the key structure 2 is eliminated, an elastic force provided by the elastic element 23 is exerted on the keycap 22. Due to the elastic force, the keycap 22 is moved upwardly with respect to the base plate 20, and thus the scissors-type connecting member 21 is switched from the folded state to the open-scissors state. Consequently, the keycap 22 is returned to its original position.

The configurations of the key structure 2 of the conventional keyboard device have been described above. However, some problems occur during the process of assembling the key structure 2. For example, the first end 2111 of the first frame 211 is firstly introduced into the entrance 2011A of the base plate fixing hook 2011 from the second side 204 of the base plate 20, then the scissors-type connecting member 21 is pressed down to have the first end 2111 of the first frame 211 locate between the base plate fixing hook 2011 and the stopping structure 2012, and finally the second end 2122 of the second frame 212 is introduced into the entrance 2021 of the base plate sliding hook 202 through the entrance 2021 of the base plate sliding hook 202 from the first side 203 of the base plate 20. Since the process of assembling the key structure 2 is very complicated, it is necessary to manually assemble the key structure 2. During the assembling process, since the complicated assembling tasks may fatigue the workers, the assembling efficiency is usually unsatisfied. Moreover, during the assembling process, the improper working postures of the user may damage the base plate 20 or the scissors-type connecting member 21.

SUMMARY OF THE INVENTION

The present invention relates to a key structure of a keyboard device that is easily assembled.

In accordance with an aspect of the present invention, there is provided a key structure of a keyboard device. The key structure includes a scissors-type connecting member and a base plate. The scissors-type connecting member includes a first frame and a second frame. The first frame includes a base plate fixing shaft and a keycap sliding shaft. The base plate fixing shaft is arranged at a first end of the first frame. The keycap sliding shaft is arranged at a second end of the first frame. The second frame is connected with the first frame, and includes a base plate sliding shaft and a keycap fixing shaft. The keycap fixing shaft is arranged at a first end of the second frame. The keycap fixing shaft is arranged at a second end of the second frame. The base plate is connected with the scissors-type connecting member. The base plate includes a first base plate perforation, a base plate fixing hook, a stopping structure and a base plate sliding hook. The first base plate perforation is arranged at a second side of the base plate for accommodating the first end of the first frame. The base plate fixing hook is arranged at a second side of the first base plate perforation to be contacted with the base plate fixing shaft. An entrance of the base plate fixing hook faces a first side of the base plate. The stopping structure is arranged at a first side of the first base plate perforation and protruded from a top surface of the base plate for stopping the base plate fixing shaft from being out of a space between the base plate fixing hook and the stopping structure. A gap between the stopping structure and the entrance of the base plate fixing hook is smaller than a diameter of the base plate fixing shaft. The base plate sliding hook is arranged at the first side of the base plate. An entrance of the base plate sliding hook faces the first side of the base plate for accommodating the base plate sliding shaft.

In an embodiment, the key structure further includes a membrane switch, a keycap and an elastic element. The membrane switch is disposed on the base plate. When the membrane switch is triggered, the membrane switch generates a key signal. The keycap is connected with the scissors-type connecting member. When the keycap is depressed, the membrane switch is triggered. The elastic element is disposed on the membrane switch. An upper portion of the elastic element is in contact with the keycap, and a lower portion of the elastic element is in contact with the membrane switch. When the elastic element is pushed by the keycap, the membrane switch is triggered by the elastic element. Whereas, when a depressing force exerted on the keycap is eliminated, an elastic force provided by the elastic element is exerted on the keycap.

In an embodiment, the keycap includes a keycap fixing structure and a keycap sliding hook. The keycap fixing structure is disposed over the base plate fixing hook for accommodating the keycap fixing shaft of the scissors-type connecting member and fixing the keycap fixing shaft therein. The keycap sliding hook is arranged at a first side of the keycap for accommodating the keycap sliding shaft.

In an embodiment, when the keycap is depressed, the keycap fixing shaft and the base plate fixing shaft are respectively rotated within the keycap fixing structure and the base plate fixing hook, and the keycap sliding shaft and the base plate sliding shaft are respectively moved within the keycap sliding hook and the base plate sliding hook and toward the first side of the base plate, so that the scissors-type connecting member is switched from an open-scissors state to a folded state and the elastic element is pushed by the keycap to trigger the membrane switch to generate the key signal. Whereas, when the depressing force exerted on the keycap is eliminated, the elastic force provided by the elastic element is exerted on the keycap. In response to the elastic force, the keycap fixing shaft and the base plate fixing shaft are respectively rotated within the keycap fixing structure and the base plate fixing hook, and the keycap sliding shaft and the base plate sliding shaft are respectively moved within the keycap sliding hook and the base plate sliding hook and toward the second side of the base plate, so that the keycap is moved to an original position.

In an embodiment, the first frame has a first bottom surface, and the second frame has a second bottom surface. The base plate fixing shaft is protruded from the first bottom surface. The base plate sliding shaft is protruded from the second bottom surface.

In an embodiment, the base plate further includes a second base plate perforation, which is arranged at the first side of the base plate, and disposed in the vicinity of the base plate sliding hook for accommodating the base plate sliding shaft.

In an embodiment, the membrane switch includes a first membrane slot and a second membrane slot. The first membrane slot is arranged at a second side of the membrane switch, wherein the base plate fixing shaft and the base plate fixing hook are penetrated through the first membrane slot. The second membrane slot is arranged at a first side of the membrane switch, wherein the base plate sliding shaft and the base plate sliding hook are penetrated through the second membrane slot.

In accordance with an aspect of the present invention, there is provided a key structure of a keyboard device. The key structure includes a scissors-type connecting member and a base plate. The scissors-type connecting member includes a first frame and a second frame. The first frame includes a base plate fixing shaft, a keycap sliding shaft and a bulge. The base plate fixing shaft is arranged at a first end of the first frame. The bulge is arranged at a middle portion of the base plate fixing shaft. The keycap sliding shaft is arranged at a second end of the first frame. The second frame is connected with the first frame, and includes a base plate sliding shaft and a keycap fixing shaft. The keycap fixing shaft is arranged at a first end of the second frame, and the keycap fixing shaft is arranged at a second end of the second frame. The base plate is connected with the scissors-type connecting member. The base plate includes a first base plate perforation, a base plate fixing hook, a second base plate perforation and a base plate sliding hook. The first base plate perforation is arranged at a second side of the base plate for accommodating the first end of the first frame. The base plate fixing hook is arranged at a second side of the first base plate perforation to be contacted with the base plate fixing shaft. An entrance of the base plate fixing hook faces a first side of the base plate. The second base plate perforation is arranged at a first side of the first base plate perforation for accommodating the bulge, wherein a sidewall of the second base plate perforation is in contact with a sidewall of the bulge. The base plate sliding hook is arranged at the first side of the base plate, wherein an entrance of the base plate sliding hook faces the first side of the base plate for accommodating the base plate sliding shaft.

In an embodiment, the key structure further includes a membrane switch, a keycap and an elastic element. The membrane switch is disposed on the base plate. When the membrane switch is triggered, the membrane switch generates a key signal. The keycap is connected with the scissors-type connecting member. When the keycap is depressed, the membrane switch is triggered. The elastic element is disposed on the membrane switch. An upper portion of the elastic element is in contact with the keycap, and a lower portion of the elastic element is in contact with the membrane switch. When the elastic element is pushed by the keycap, the membrane switch is triggered by the elastic element. Whereas, when a depressing force exerted on the keycap is eliminated, an elastic force provided by the elastic element is exerted on the keycap.

In an embodiment, the keycap includes a keycap fixing structure and a keycap sliding hook. The keycap fixing structure is disposed over the base plate fixing hook for accommodating the keycap fixing shaft of the scissors-type connecting member and fixing the keycap fixing shaft therein. The keycap sliding hook is arranged at a first side of the keycap for accommodating the keycap sliding shaft.

In an embodiment, when the keycap is depressed, the keycap fixing shaft and the base plate fixing shaft are respectively rotated within the keycap fixing structure and the base plate fixing hook, and the keycap sliding shaft and the base plate sliding shaft are respectively moved within the keycap sliding hook and the base plate sliding hook and toward the first side of the base plate, so that the scissors-type connecting member is switched from an open-scissors state to a folded state and the elastic element is pushed by the keycap to trigger the membrane switch to generate the key signal. Whereas, when the depressing force exerted on the keycap is eliminated, the elastic force provided by the elastic element is exerted on the keycap. In response to the elastic force, the keycap fixing shaft and the base plate fixing shaft are respectively rotated within the keycap fixing structure and the base plate fixing hook, and the keycap sliding shaft and the base plate sliding shaft are respectively moved within the keycap sliding hook and the base plate sliding hook and toward the second side of the base plate, so that the keycap is moved to an original position.

In an embodiment, the first frame has a first bottom surface, and the second frame has a second bottom surface. The base plate fixing shaft is protruded from the first bottom surface. The base plate sliding shaft is protruded from the second bottom surface.

In an embodiment, the base plate further includes a third base plate perforation, which is arranged at the first side of the base plate, and disposed in the vicinity of the base plate sliding hook for accommodating the base plate sliding shaft.

In an embodiment, the membrane switch includes a first membrane slot and a second membrane slot. The first membrane slot is arranged at a second side of the membrane switch, wherein the base plate fixing shaft and the base plate fixing hook are penetrated through the first membrane slot. The second membrane slot is arranged at a first side of the membrane switch, wherein the base plate sliding shaft and the base plate sliding hook are penetrated through the second membrane slot.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
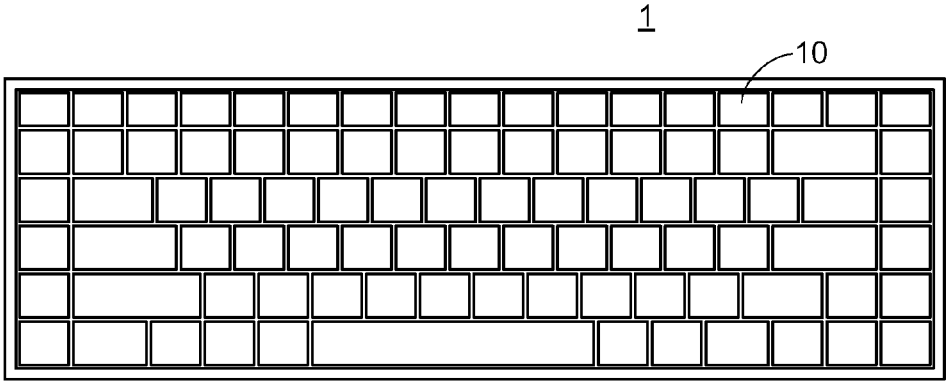
FIG.1 PRIOR ART
FIG. 1 is a schematic view illustrating the outward appearance of a conventional keyboard device.
Figure 2:
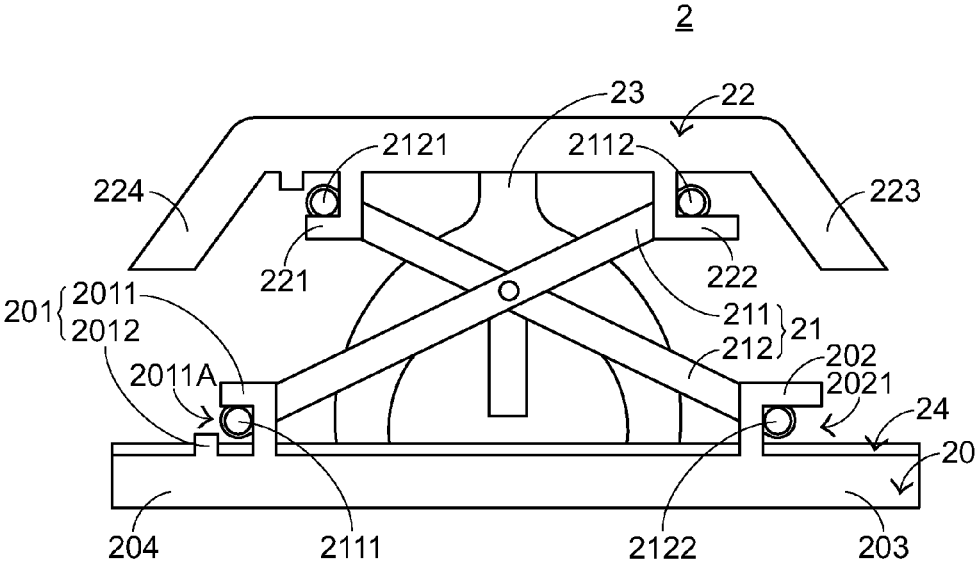
FIG.2 PRIOR ART
FIG. 2 is a schematic side view illustrating a key structure of a conventional keyboard device.
Figure 3:
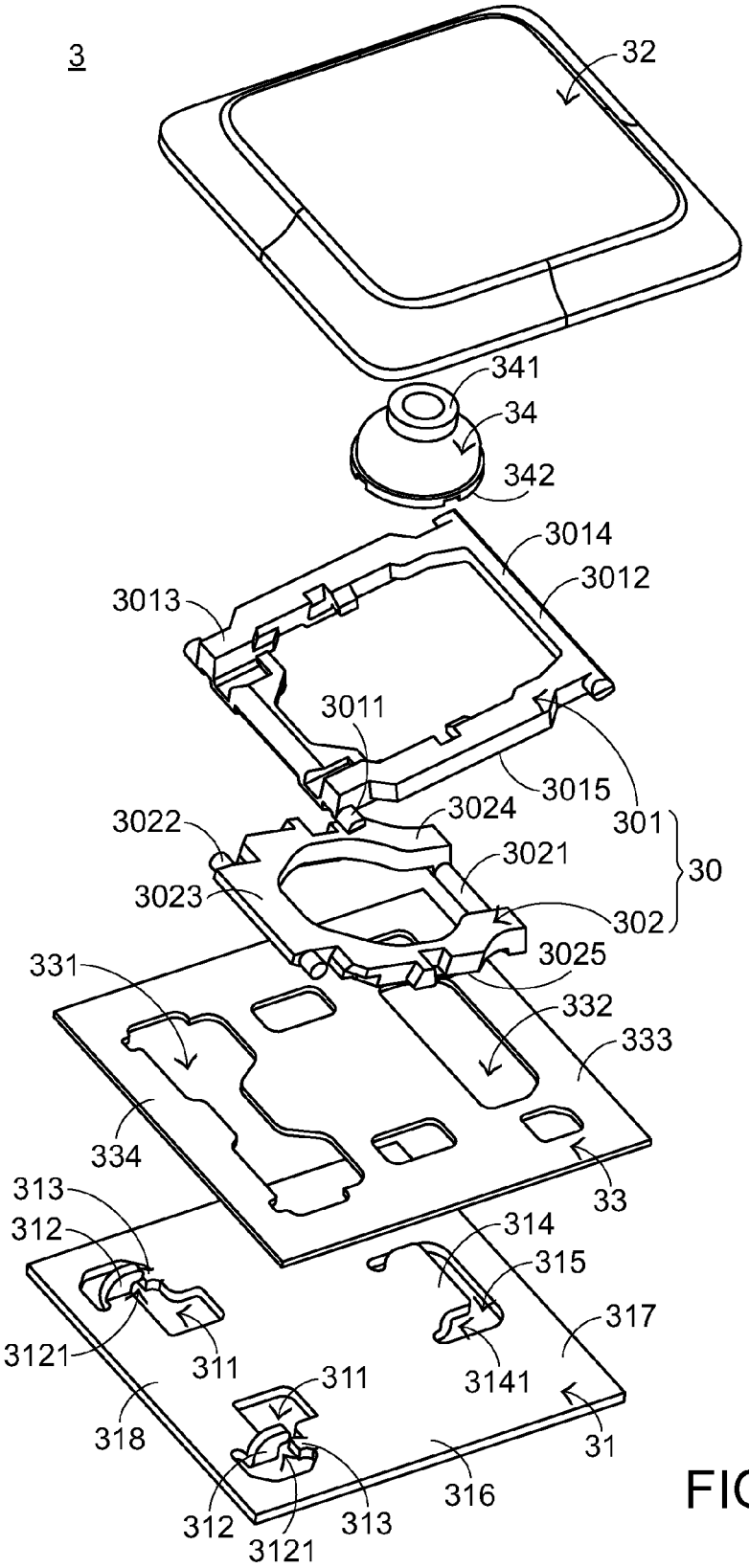
FIG. 3 is a schematic exploded view illustrating a key structure of a keyboard device according to a first embodiment of the present invention.

For obviating the drawbacks encountered from the prior art, the present invention provides a key structure of a keyboard device. FIG. 3 is a schematic exploded view illustrating a key structure of a keyboard device according to a first embodiment of the present invention. As shown in FIG. 3, the key structure 3 of the keyboard device comprises a scissors-type connecting member 30, a base plate 31, a keycap 32, a membrane switch 33 and an elastic element 34. The scissors-type connecting member 30 is arranged between the keycap 32 and the membrane switch 33. The scissors-type connecting member 30 comprises a first frame 301 and a second frame 302. The first frame 301 comprises a base plate fixing shaft 3011 and a keycap sliding shaft 3012. The base plate fixing shaft 3011 is arranged at a first end 3013 of the first frame 301. The keycap sliding shaft 3012 is arranged at a second end 3014 of the first frame 301. In addition, the base plate fixing shaft 3011 is protruded from a first bottom surface 3015 of the first frame 301. The second frame 302 comprises a base plate sliding shaft 3021 and a keycap fixing shaft 3022. The keycap fixing shaft 3022 is arranged at a first end 3023 of the second frame 302. The keycap fixing shaft 3022 is arranged at a second end 3024 of the second frame 302. In addition, the base plate sliding shaft 3021 is protruded from a second bottom surface 3025 of the second frame 302.

Please refer to FIG. 3 again. The base plate 31 is arranged under the membrane switch 33. The base plate 31 comprises a first base plate perforation 311, a base plate fixing hook 312, a stopping structure 313, a base plate sliding hook 314 and a second base plate perforation 315. The first base plate perforation 311 is arranged at a second side 318 of the base plate 31. The base plate fixing hook 312 is arranged at a second side of the first base plate perforation 311. In addition, an entrance 3121 of the base plate fixing hook 312 faces a first side 317 of the base plate 31. The stopping structure 313 is arranged at a first side of the first base plate perforation 311. In addition, the stopping structure 313 is protruded from a top surface 316 of the base plate 31. The base plate sliding hook 314 is arranged at the first side 317 of the base plate 31. In addition, an entrance 3141 of the base plate sliding hook 314 faces the first side 317 of the base plate 31. The second base plate perforation 315 is arranged at the first side 317 of the base plate 31, and disposed in the vicinity of the base plate sliding hook 314. In the base plate 31, the entrance 3121 of the base plate fixing hook 312 and the entrance 3141 of the base plate sliding hook 314 both face the first side 317 of the base plate 31. The membrane switch 33 comprises a first membrane slot 331 and a second membrane slot 332. The second membrane slot 332 is arranged at a first side 333 of the membrane switch 33. The first membrane slot 331 is arranged at a second side 334 of the membrane switch 33. The elastic element 34 is arranged between the keycap 32 and the membrane switch 33. In addition, the elastic element 34 comprises an upper portion 341 and a lower portion 342.

Figure 4:
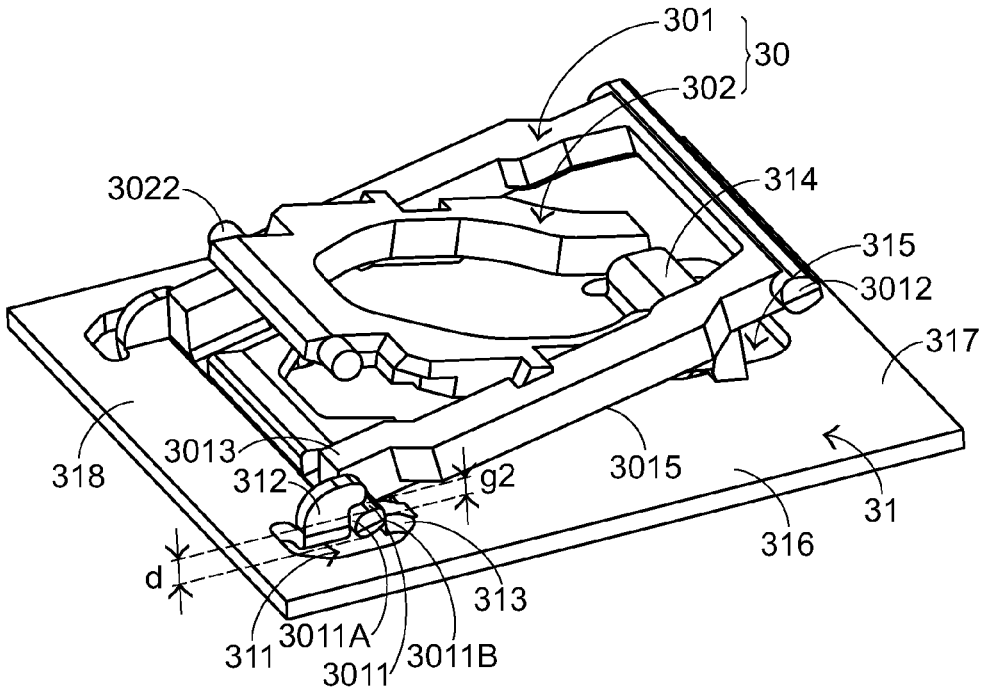
FIG. 4 is a schematic fragmentary perspective view illustrating the key structure of the keyboard device according to the first embodiment of the present invention.
Figure 5:
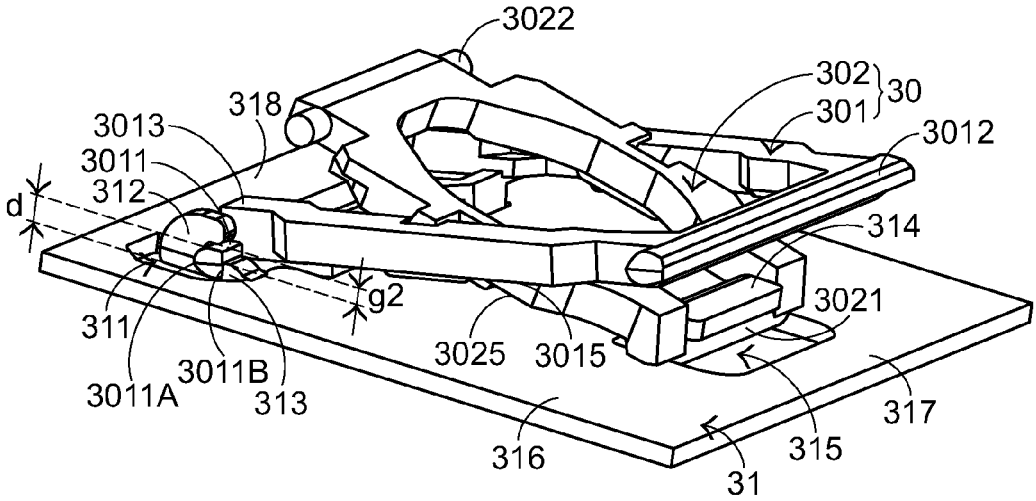
FIG. 5 is a schematic fragmentary perspective view illustrating the key structure of FIG. 4 and taken along another viewpoint.

Hereinafter, a process of connecting the scissors-type connecting member 30 with the base plate 31 of the key structure 3 will be illustrated with reference to FIGS. 4 and 5. FIG. 4 is a schematic fragmentary perspective view illustrating the key structure of the keyboard device according to the first embodiment of the present invention. FIG. 5 is a schematic fragmentary perspective view illustrating the key structure of FIG. 4 and taken along another viewpoint. The base plate fixing shaft 3011 of the first frame 301 is accommodated within the space between the base plate fixing hook 312 and the stopping structure 313. A gap g1 between the base plate fixing hook 312 and the stopping structure 313 (see FIG. 6) is greater than or equal to the diameter d of the base plate fixing shaft 3011. In such way, the base plate fixing hook 312 is in contact with a first rim 3011A of the base plate fixing shaft 3011, and the stopping structure 313 is in contact with a second rim 3011B of the base plate fixing shaft 3011, thereby stopping the base plate fixing shaft 3011 from being out of the space between the base plate fixing hook 312 and the stopping structure 313. Moreover, since the gap g1 between the base plate fixing hook 312 and the stopping structure 313 is greater than or equal to the diameter d of the base plate fixing shaft 3011, the base plate fixing shaft 3011 is rotatable within the space between the base plate fixing hook 312 and the stopping structure 313.

The base plate sliding shaft 3021 of the second frame 302 is accommodated within the base plate sliding hook 314 and in contact with the base plate sliding hook 314. The base plate sliding shaft 3021 is movable in the base plate sliding hook 314. In response to a depressing action of the key structure 3, the base plate sliding shaft 3021 and the base plate fixing shaft 3011 are synchronously rotated. Moreover, the first end 3013 of the first frame 301 and the part of the base plate fixing shaft 3011 protruded from the first bottom surface 3015 are inserted into the first base plate perforation 311. In addition, the base plate sliding shaft 3021 is inserted into the second base plate perforation 315.

Figure 6:
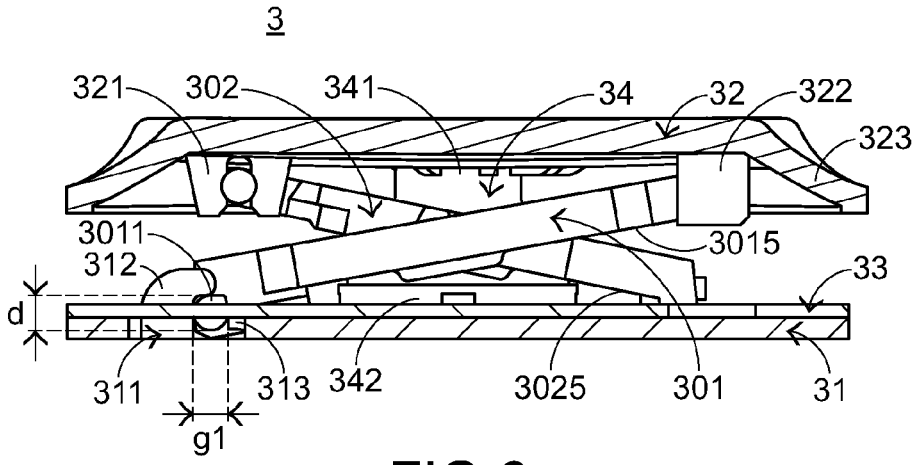
FIG. 6 is a schematic side view illustrating the key structure of the keyboard device according to the first embodiment of the present invention, in which the key structure has not been depressed.
Figure 7:
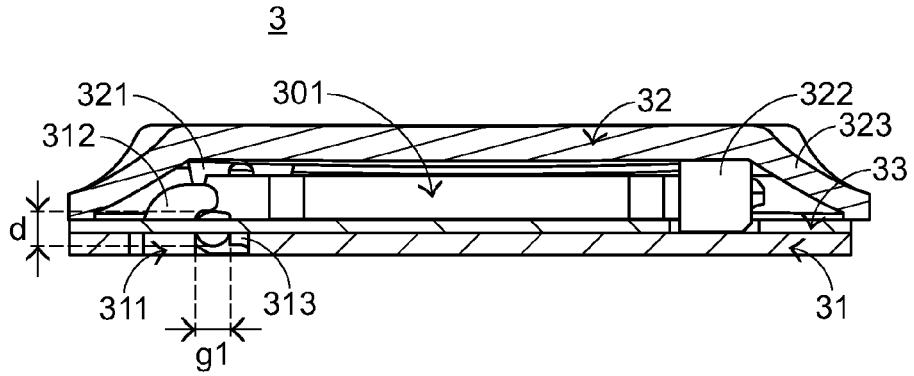
FIG. 7 is a schematic side view illustrating the key structure of the keyboard device according to the first embodiment of the present invention, in which the key structure has been depressed.

Please refer to FIGS. 6 and 7. FIG. 6 is a schematic side view illustrating the key structure of the keyboard device according to the first embodiment of the present invention, in which the key structure has not been depressed. FIG. 7 is a schematic side view illustrating the key structure of the keyboard device according to the first embodiment of the present invention, in which the key structure has been depressed. As shown in FIGS. 6 and 7, the keycap 32 comprises a keycap fixing structure 321 and a keycap sliding hook 322. The keycap fixing structure 321 is disposed over the base plate fixing hook 312 for accommodating the keycap fixing shaft 3022 of the scissors-type connecting member 30 and fixing the keycap fixing shaft 3022 therein. The keycap sliding hook 322 is arranged at a first side 323 of the keycap 32 for accommodating the keycap sliding shaft 3012. The membrane switch 33 is disposed on the base plate 31. The base plate fixing hook 312 is penetrated through the first membrane slot 331. When the base plate fixing shaft 3011 is accommodated within the space between the base plate fixing hook 312 and the stopping structure 313, the base plate fixing shaft 3011 is penetrated through the first membrane slot 331 and the inserted into the first base plate perforation 311. Whereas, the base plate sliding hook 314 is penetrated through the second membrane slot 332. When the base plate sliding shaft 3021 is accommodated within the base plate sliding hook 314, the base plate sliding shaft 3021 is penetrated through the second membrane slot 332 and inserted into the second base plate perforation 315. The elastic element 34 is disposed on the membrane switch 33. The upper portion 341 of the elastic element 34 is in contact with the keycap 32. The lower portion 342 of the elastic element 34 is in contact with the membrane switch 33.

When the keycap 32 of the key structure 3 of the keyboard device is depressed, the keycap fixing shaft 3022 and the base plate fixing shaft 3011 are rotated within the keycap fixing structure 321 and the base plate fixing hook 312, respectively. At the same time, the keycap sliding shaft 3012 and the base plate sliding shaft 3021 are respectively moved within the keycap sliding hook 322 and the base plate sliding hook 314 and toward the first side 317 of the base plate 31. Under this circumstance, the scissors-type connecting member 30 is switched from an open-scissors state to a folded state. Since the keycap 32 is moved downwardly to push against the elastic element 34, the membrane switch 33 is triggered by the elastic element 34 to generate a key signal (see FIG. 7).

Whereas, when the depressing force exerted on the keycap 32 is eliminated, an elastic force provided by the elastic element 34 is exerted on the keycap 32. Due to the elastic force, the keycap fixing shaft 3022 and the base plate fixing shaft 3011 are rotated within the keycap fixing structure 321 and the base plate fixing hook 312, respectively. At the same time, the keycap sliding shaft 3012 and the base plate sliding shaft 3021 are respectively moved within the keycap sliding hook 322 and the base plate sliding hook 314 and toward the second side 318 of the base plate 31. Consequently, the keycap 32 is moved to an original position where the keycap 32 has not been depressed.

During the process of connecting the scissors-type connecting member 30 with the base plate 31, the base plate sliding shaft 3021 of the second frame 302 is introduced into the base plate sliding hook 314 through the entrance 3141 of the base plate sliding hook 314. In addition, the base plate fixing shaft 3011 of the first frame 301 is introduced into the base plate fixing hook 312 through the entrance 3121 of the base plate fixing hook 312. In the base plate fixing hook 312, a gap g2 between the entrance 3121 of the base plate fixing hook 312 and the stopping structure 313 is smaller than the diameter d of the base plate fixing shaft 3011. Normally, the base plate fixing shaft 3011 is stopped from entering the space between the entrance 3121 of the base plate fixing hook 312 and the stopping structure 313. Whereas, for connecting the scissors-type connecting member 30 with the base plate 31, the base plate fixing shaft 3011 is pushed against the base plate fixing hook 312 and the stopping structure 313 to result in deformation of the stopping structure 313. Due to deformation of the stopping structure 313, the gap g2 between the entrance 3121 of the base plate fixing hook 312 and the stopping structure 313 is greater than or equal to the diameter d of the base plate fixing shaft 3011. Under this circumstance, the base plate fixing shaft 3011 is allowed to be introduced into and accommodated within the space between the base plate fixing hook 312 and the stopping structure 313. After the base plate fixing shaft 3011 is transported through the space between the entrance 3121 of the base plate fixing hook 312 and the stopping structure 313, the deformed stopping structure 313 is restored to its original shape. Meanwhile, the gap g2 is returned to be smaller than the diameter d of the base plate fixing shaft 3011, thereby stopping the base plate fixing shaft 3011 from being out of the space between the base plate fixing hook 312 and the stopping structure 313. The configurations and operating principles of the key structure of the keyboard device according to the first embodiment of the present invention has been described above.

Figure 8:
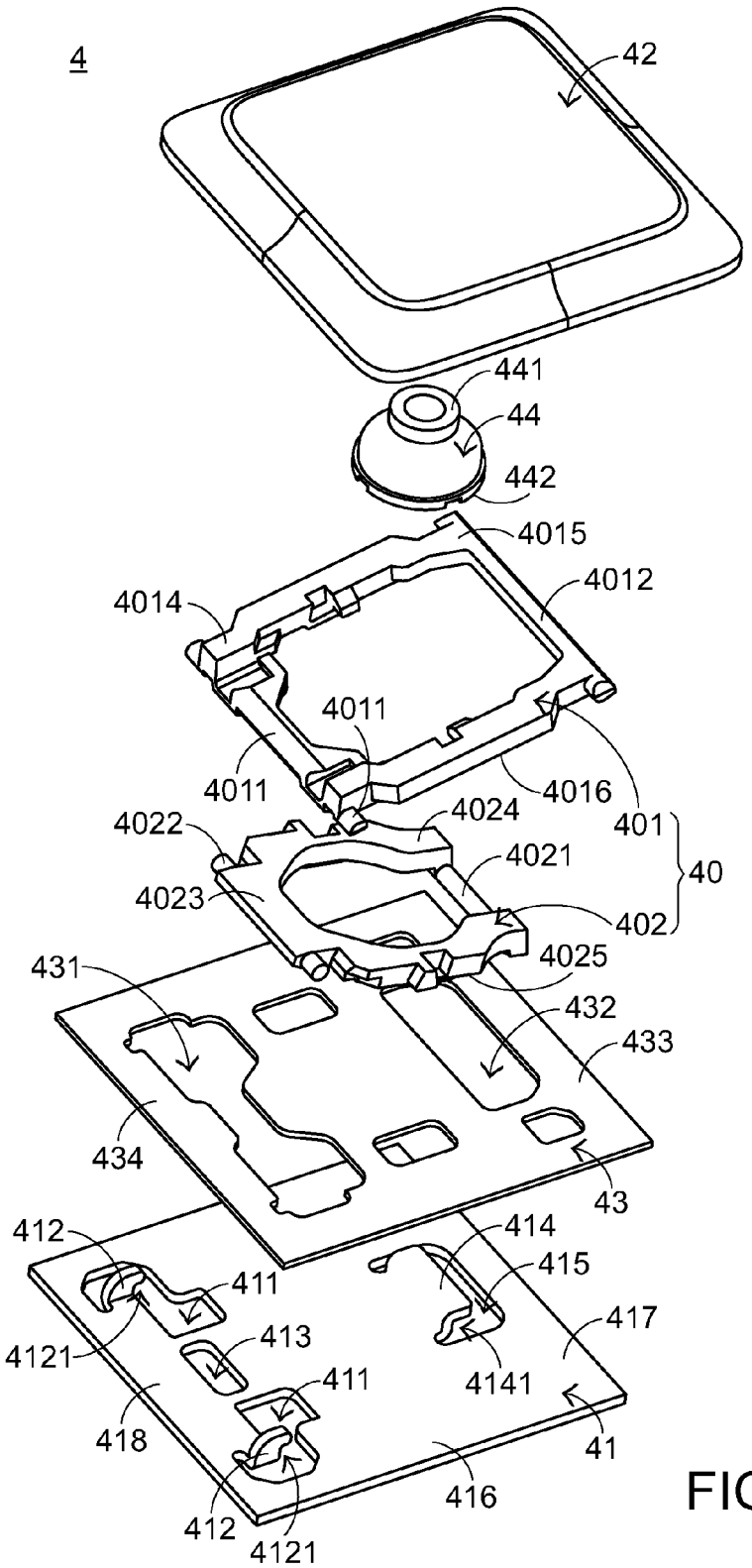
FIG. 8 is a schematic exploded view illustrating a key structure of a keyboard device according to a second embodiment of the present invention.

The present invention further provides a second embodiment of the key structure. FIG. 8 is a schematic exploded view illustrating a key structure of a keyboard device according to a second embodiment of the present invention. As shown in FIG. 8, the key structure 4 of the keyboard device comprises a scissors-type connecting member 40, a base plate 41, a keycap 42, a membrane switch 43 and an elastic element 44. The structures of the keycap 42, the membrane switch 43 and the elastic element 44 are similar to those of the first embodiment, and are not redundantly described herein. The scissors-type connecting member 40 is arranged between the keycap 42 and the membrane switch 43. The scissors-type connecting member 40 comprises a first frame 401 and a second frame 402. The first frame 401 comprises a base plate fixing shaft 4011, a keycap sliding shaft 4012 and a bulge 4013 (see FIG. 10). The base plate fixing shaft 4011 is arranged at a first end 4014 of the first frame 401. The keycap sliding shaft 4012 is arranged at a second end 4015 of the first frame 401. The bulge 4013 is arranged at a middle portion of the base plate fixing shaft 4011. In addition, the base plate fixing shaft 4011 is protruded from a first bottom surface 4015 of the first frame 401. The second frame 402 comprises a base plate sliding shaft 4021 and a keycap fixing shaft 4022. The keycap fixing shaft 4022 is arranged at a first end 4023 of the second frame 402. The keycap fixing shaft 4022 is arranged at a second end 4024 of the second frame 402. In addition, the base plate sliding shaft 4021 is protruded from a second bottom surface 4025 of the second frame 402.

Please refer to FIG. 8 again. The base plate 41 is arranged under the membrane switch 43. The base plate 41 comprises a first base plate perforation 411, a base plate fixing hook 412, a second base plate perforation 413, a base plate sliding hook 414 and a third base plate perforation 415. The first base plate perforation 411 is arranged at a second side 418 of the base plate 41. The base plate fixing hook 412 is arranged at a second side of the first base plate perforation 411. In addition, an entrance 4121 of the base plate fixing hook 412 faces a first side 417 of the base plate 41. The second base plate perforation 413 is arranged at a first side of the first base plate perforation 411. The base plate sliding hook 414 is arranged at the first side 417 of the base plate 41. In addition, an entrance 4141 of the base plate sliding hook 414 faces the first side 417 of the base plate 41. The third base plate perforation 415 is arranged at the first side 417 of the base plate 41, and disposed in the vicinity of the base plate sliding hook 414. In the base plate 41, the entrance 4121 of the base plate fixing hook 412 and the entrance 4141 of the base plate sliding hook 414 both face the first side 417 of the base plate 41.

Figure 9:
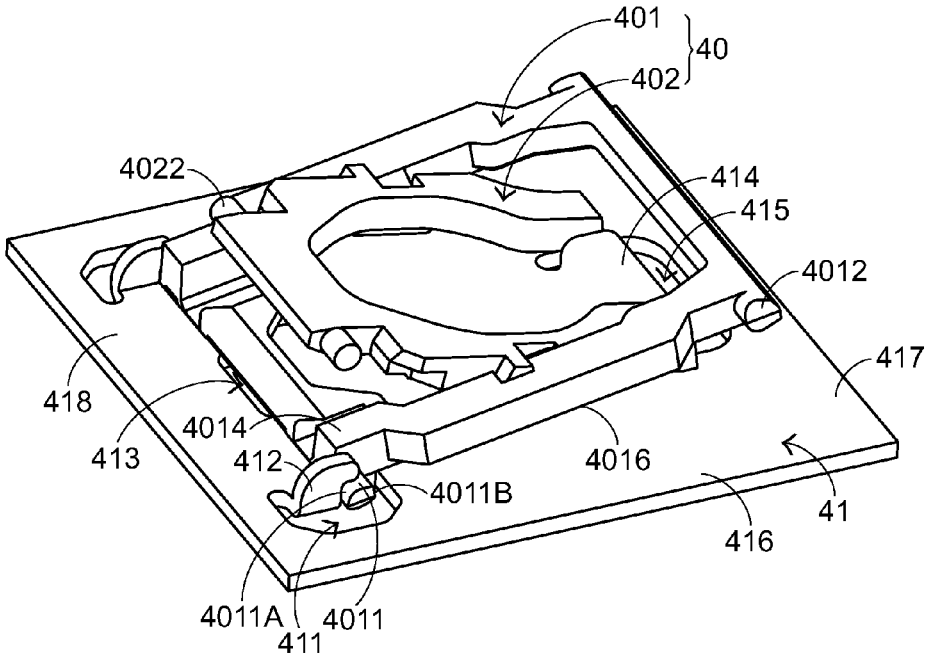
FIG. 9 is a schematic fragmentary perspective view illustrating the key structure of the keyboard device according to the second embodiment of the present invention.
Figure 10:
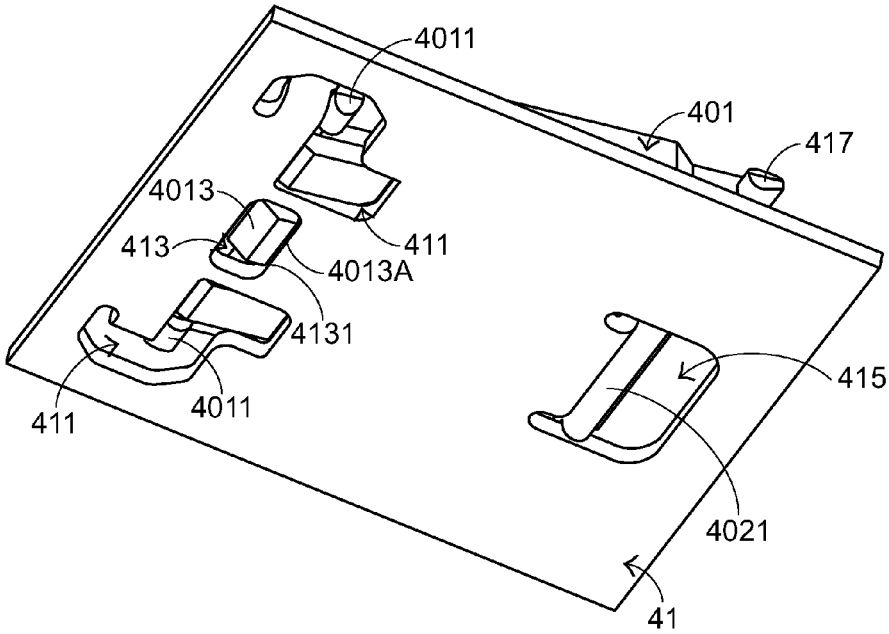
FIG. 10 is a schematic fragmentary perspective view illustrating the key structure of FIG. 9 and taken along another viewpoint.

Hereinafter, a process of connecting the scissors-type connecting member 40 with the base plate 41 of the key structure 4 will be illustrated with reference to FIGS. 9 and 10. FIG. 9 is a schematic fragmentary perspective view illustrating the key structure of the keyboard device according to the second embodiment of the present invention. FIG. 10 is a schematic fragmentary perspective view illustrating the key structure of FIG. 9 and taken along another viewpoint. The base plate fixing shaft 4011 of the first frame 401 is accommodated within the base plate fixing hook 412. The base plate fixing hook 412 is in contact with a first rim 4011A of the base plate fixing shaft 4011. The bulge 4013 of the first frame 401 is inserted into the second base plate perforation 413. In addition, a sidewall 4131 of the second base plate perforation 413 is in contact with a sidewall 4013A of the bulge 4013.

The base plate sliding shaft 4021 of the second frame 402 is accommodated within the base plate sliding hook 414 and in contact with the base plate sliding hook 414. The base plate sliding shaft 4021 is movable in the base plate sliding hook 414. In response to a depressing action of the key structure 4, the base plate sliding shaft 4021 and the base plate fixing shaft 4011 are synchronously rotated. The depressing actions of the key structure 4 are similar to those of the first embodiment, and are not redundantly described herein. Moreover, the first end 4014 of the first frame 401 and the part of the base plate fixing shaft 4011 protruded from the first bottom surface 4015 are inserted into the first base plate perforation 411. The bulge 4013 at the middle portion of the first end 4014 of the first frame 401 (e.g. at the middle portion of the base plate fixing shaft 4011) is inserted into the second base plate perforation 413. In addition, the base plate sliding shaft 4021 is inserted into the third base plate perforation 415 (see FIG. 10).

Figure 11:
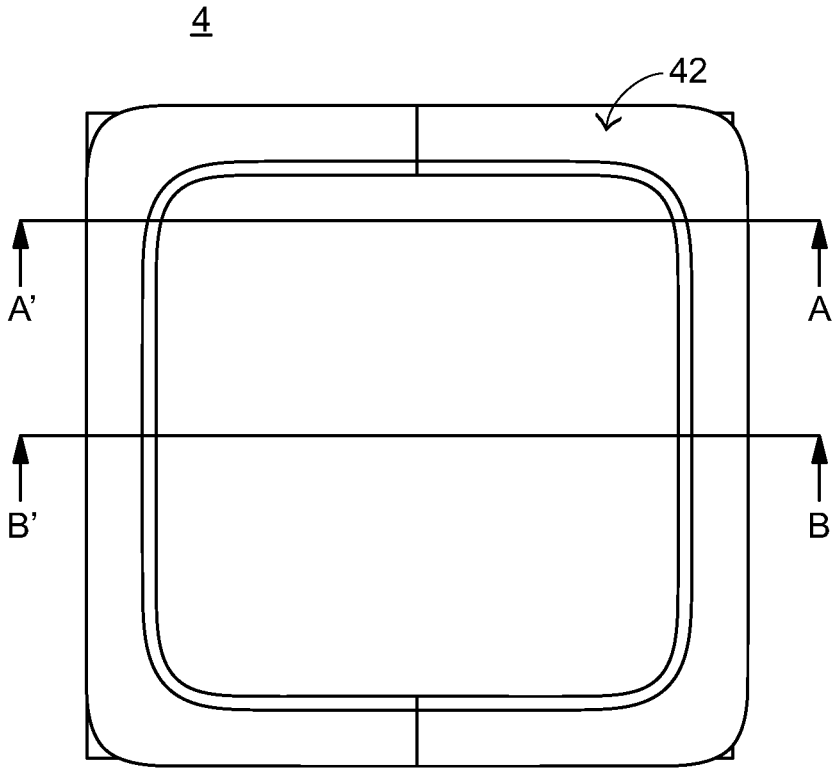
FIG. 11 is a schematic top view illustrating the key structure of the keyboard device according to the second embodiment of the present invention.

Please refer to FIG. 11, which is a schematic top view illustrating the key structure of the keyboard device according to the second embodiment of the present invention. For further understanding the key structure 42 of the keyboard device, the cross-section A-A' and the cross-section B-B' are shown. The cross-section A-A' is a plane at an edge of the key structure 4 while passing through the base plate fixing shaft 4011. The cross-section B-B' is a plane near the middle portion of the key structure 4 while passing through the base plate sliding shaft 4021.

Figure 12:
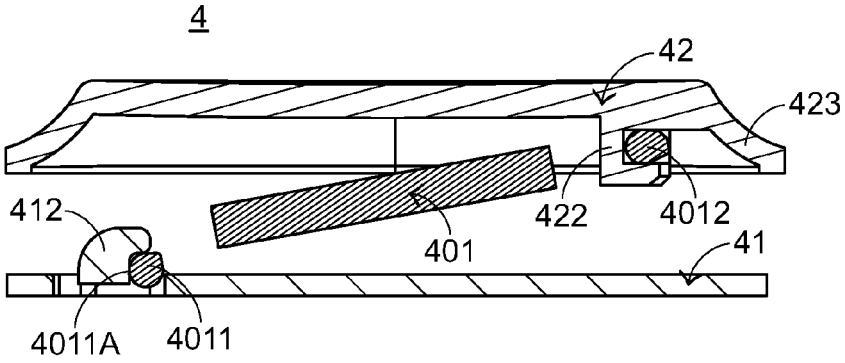
FIG. 12 is a schematic fragmentary side view illustrating the cross-section A-A' of the key structure of the keyboard device according to the second embodiment of the present invention.
Figure 13:
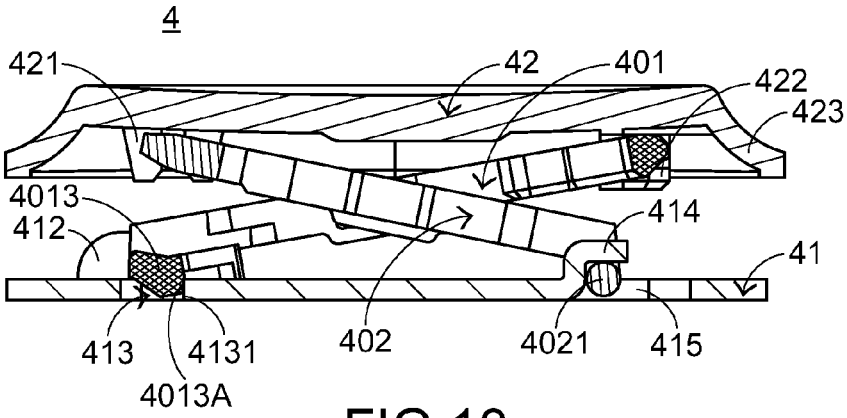
FIG. 13 is a schematic fragmentary side view illustrating the cross-section B-B' of the key structure of the keyboard device according to the second embodiment of the present invention.

FIG. 12 is a schematic fragmentary side view illustrating the cross-section A-A' of the key structure of the keyboard device according to the second embodiment of the present invention. FIG. 13 is a schematic fragmentary side view illustrating the cross-section B-B' of the key structure of the keyboard device according to the second embodiment of the present invention. As shown in FIGS. 12 and 13, the keycap 42 comprises a keycap fixing structure 421 and a keycap sliding hook 422. The keycap fixing structure 421 is disposed over the base plate fixing hook 412 for accommodating the keycap fixing shaft 4022 of the scissors-type connecting member 40 and fixing the keycap fixing shaft 4022 therein. The keycap sliding hook 422 is arranged at a first side 423 of the keycap 42 for accommodating the keycap sliding shaft 4012.

Please refer to FIGS. 12 and 13 again. After the base plate fixing shaft 4011 is accommodated within the base plate fixing hook 412, the first rim 4011A of the base plate fixing shaft 4011 is and positioned stopped by the base plate fixing hook 412. Similarly, after the bulge 4013 is accommodated within the second base plate perforation 413, the sidewall 4013A of the bulge 4013 is stopped and positioned by the sidewall 4131 of the second base plate perforation 413. That is, the base plate fixing hook 412 and the sidewall 4131 of the second base plate perforation 413 may facilitate fixing the first end 4014 of the first frame 401 on the base plate 41 and allow the base plate fixing shaft 4011 to be rotated within the base plate fixing hook 412, thereby stopping the base plate fixing shaft 4011 from being out of the base plate fixing hook 412.

During the scissors-type connecting member 40 is connected with the base plate 41, the base plate sliding shaft 4021 of the second frame 402 should be introduced into the base plate sliding hook 414 through the entrance 4141 of the base plate sliding hook 414. In addition, the base plate fixing shaft 4011 of the first frame 401 is introduced into the base plate fixing hook 412 through the entrance 4121 of the base plate fixing hook 412. However, during the base plate sliding shaft 4021 introduced into the base plate sliding hook 414, since the bulge 4013 at the middle portion of the base plate fixing shaft 4011 is hindered by a top surface 416 of the base plate 41 and fails to be accommodated within the second base plate perforation 413, the base plate sliding shaft 4021 is not in direct contact with the base plate sliding hook 414. Whereas, for connecting the scissors-type connecting member 40 with the base plate 41, the base plate fixing shaft 4011 is pushed against the top surface 416 to result in deformation of the base plate fixing shaft 4011. Due to deformation of the base plate fixing shaft 4011, the bulge 4013 at the middle portion of the base plate fixing shaft 4011 can be inserted into and accommodated within the second base plate perforation 413. After the bulge 4013 is accommodated within the second base plate perforation 413, the deformed base plate fixing shaft 4011 is restored to its original shape, thereby stopping the bulge 4013 from being out of the second base plate perforation 413.

From the above description, in the key structure of the keyboard device of the present invention, the entrance of the base plate fixing hook and the entrance of the base plate sliding hook face the same side. In such way, the scissors-type connecting member can be easily transported through the entrance of the base plate fixing hook and the entrance of the base plate sliding hook, so that the key structure can be easily assembled. In addition to the benefit of being easily assembled, the key structure of the keyboard device of the present invention uses the stopping structure or the second base plate perforation to confine the base plate fixing shaft, thereby stopping the base plate fixing shaft from being out of base plate fixing hook. In comparison with the key structure of the conventional keyboard device, the key structure of the keyboard device of the present invention is assembled more easily.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A key structure of a keyboard device, said key structure comprising:

a scissors-type connecting member;

a first frame comprising a base plate fixing shaft and a keycap sliding shaft, wherein said base plate fixing shaft is arranged at a first end of said first frame, and said keycap sliding shaft is arranged at a second end of said first frame; and a second frame connected with said first frame, and comprising a base plate sliding shaft and a keycap fixing shaft, wherein said keycap fixing shaft is arranged at a first end of said second frame, and said base plate sliding shaft is arranged at a second end of said second frame; and a base plate connected with said scissors-type connecting member, and comprising:

a first base plate perforation arranged at a second side of said base plate for accommodating said first end of said first frame;

a base plate fixing hook arranged at a second side of said first base plate perforation to be contacted with said base plate fixing shaft, wherein an entrance of said base plate fixing hook faces a first side of said base plate;

a stopping structure arranged at a first side of said first base plate perforation and protruded from a top surface of said base plate for stopping said base plate fixing shaft from being out of a space between said base plate fixing hook and said stopping structure, wherein a gap between said stopping structure and said entrance of said base plate fixing hook is smaller than a diameter of said base plate fixing shaft; and a base plate sliding hook arranged at said first side of said base plate, wherein an entrance of said base plate sliding hook faces said first side of said base plate for accommodating said base plate sliding shaft; and wherein the entrance of the base plate fixing hook and the entrance of the base plate sliding hook face the same side of the base plate so that, upon assembly of the scissors-type connecting member with the base plate, the base plate sliding shaft is transported through the entrance of the base plate sliding hook and the base plate fixing shaft is transported through the entrance of the base plate fixing hook.

2. The key structure according to claim 1 further comprising:

a membrane switch disposed on said base plate, wherein when said membrane switch is triggered, said membrane switch generates a key signal;

a keycap connected with said scissors-type connecting member, wherein when said keycap is depressed, said membrane switch is triggered; and an elastic element disposed on said membrane switch, wherein an upper portion of said elastic element is in contact with said keycap, and a lower portion of said elastic element is in contact with said membrane switch, wherein when said elastic element is pushed by said keycap, said membrane switch is triggered by said elastic element, wherein when a depressing force exerted on said keycap is eliminated, an elastic force provided by said elastic element is exerted on said keycap.

3. The key structure according to claim 2 wherein said keycap comprises:

a keycap fixing structure disposed over said base plate fixing hook for accommodating said keycap fixing shaft of said scissors-type connecting member and fixing said keycap fixing shaft therein; and a keycap sliding hook arranged at a first side of said keycap for accommodating said keycap sliding shaft.

4. The key structure according to claim 3 wherein when said keycap is depressed, said keycap fixing shaft and said base plate fixing shaft are respectively rotated within said keycap fixing structure and the base plate fixing hook, and said keycap sliding shaft and said base plate sliding shaft are respectively moved within said keycap sliding hook and said base plate sliding hook and toward said first side of said base plate, so that said scissors-type connecting member is switched from an open-scissors state to a folded state and said elastic element is pushed by said keycap to trigger said membrane switch to generate said key signal, wherein when said depressing force exerted on said keycap is eliminated, said elastic force provided by said elastic element is exerted on said keycap, wherein in response to said elastic force, said keycap fixing shaft and said base plate fixing shaft are respectively rotated within said keycap fixing structure and the base plate fixing hook, and said keycap sliding shaft and said base plate sliding shaft are respectively moved within said keycap sliding hook and said base plate sliding hook and toward said second side of said base plate, so that said keycap is moved to an original position.

5. The key structure according to claim 1 wherein said first frame has a first bottom surface, and said second frame has a second bottom surface, wherein said base plate fixing shaft is protruded from said first bottom surface, and the base plate sliding shaft is protruded from said second bottom surface.

6. The key structure according to claim 1 wherein said base plate further comprises a second base plate perforation, which is arranged at said first side of said base plate, and disposed in the vicinity of said base plate sliding hook for accommodating said base plate sliding shaft.

7. The key structure according to claim 1 wherein said membrane switch comprises:

a first membrane slot arranged at a second side of said membrane switch, wherein said base plate fixing shaft and said base plate fixing hook are penetrated through said first membrane slot; and a second membrane slot arranged at a first side of said membrane switch, wherein said base plate sliding shaft and said base plate sliding hook are penetrated through said second membrane slot.

8. A key structure of a keyboard device, said key structure comprising:

a scissors-type connecting member;

a first frame comprising a base plate fixing shaft, a keycap sliding shaft and a bulge, wherein said base plate fixing shaft is arranged at a first end of said first frame, said bulge is arranged at a middle portion of said base plate fixing shaft, and said keycap sliding shaft is arranged at a second end of said first frame; and a second frame connected with said first frame, and comprising a base plate sliding shaft and a keycap fixing shaft, wherein said keycap fixing shaft is arranged at a first end of said second frame, and said base plate sliding shaft is arranged at a second end of said second frame; and a base plate connected with said scissors-type connecting member, and comprising:

a first base plate perforation arranged at a second side of said base plate for accommodating said first end of said first frame;

a base plate fixing hook arranged at a second side of said first base plate perforation to be contacted with said base plate fixing shaft, wherein an entrance of said base plate fixing hook faces a first side of said base plate;

a second base plate perforation arranged at a first side of said first base plate perforation for accommodating said bulge, wherein a sidewall of said second base plate perforation is in contact with a sidewall of said bulge; and a base plate sliding hook arranged at said first side of said base plate, wherein an entrance of said base plate sliding hook faces said first side of said base plate for accommodating said base plate sliding shaft; and wherein the entrance of the base plate fixing hook and the entrance of the base plate sliding hook face the same side of the base plate so that, upon assembly of the scissors-type connecting member with the base plate, the base plate sliding shaft is transported through the entrance of the base plate sliding hook and the base plate fixing shaft is transported through the entrance of the base plate fixing hook.

9. The key structure according to claim 8 further comprising:

a membrane switch disposed on said base plate, wherein when said membrane switch is triggered, said membrane switch generates a key signal;

a keycap connected with said scissors-type connecting member, wherein when said keycap is depressed, said membrane switch is triggered; and an elastic element disposed on said membrane switch, wherein an upper portion of said elastic element is in contact with said keycap, and a lower portion of said elastic element is in contact with said membrane switch, wherein when said elastic element is pushed by said keycap, said membrane switch is triggered by said elastic element, wherein when a depressing force exerted on said keycap is eliminated, an elastic force provided by said elastic element is exerted on said keycap.

10. The key structure according to claim 9 wherein said keycap comprises:

a keycap fixing structure disposed over said base plate fixing hook for accommodating said keycap fixing shaft of said scissors-type connecting member and fixing said keycap fixing shaft therein; and a keycap sliding hook arranged at a first side of said keycap for accommodating said keycap sliding shaft.

11. The key structure according to claim 10 wherein when said keycap is depressed, said keycap fixing shaft and said base plate fixing shaft are respectively rotated within said keycap fixing structure and the base plate fixing hook, and said keycap sliding shaft and said base plate sliding shaft are respectively moved within said keycap sliding hook and said base plate sliding hook and toward said first side of said base plate, so that said scissors-type connecting member is switched from an open-scissors state to a folded state and said elastic element is pushed by said keycap to trigger said membrane switch to generate said key signal, wherein when said depressing force exerted on said keycap is eliminated, said elastic force provided by said elastic element is exerted on said keycap, wherein in response to said elastic force, said keycap fixing shaft and said base plate fixing shaft are respectively rotated within said keycap fixing structure and the base plate fixing hook, and said keycap sliding shaft and said base plate sliding shaft are respectively moved within said keycap sliding hook and said base plate sliding hook and toward said second side of said base plate, so that said keycap is moved to an original position.

12. The key structure according to claim 8 wherein said first frame has a first bottom surface, and said second frame has a second bottom surface, wherein said base plate fixing shaft is protruded from said first bottom surface, and the base plate sliding shaft is protruded from said second bottom surface.

13. The key structure according to claim 8 wherein said base plate further comprises a third base plate perforation, which is arranged at said first side of said base plate, and disposed in the vicinity of said base plate sliding hook for accommodating said base plate sliding shaft.

14. The key structure according to claim 8 wherein said membrane switch comprises:

a first membrane slot arranged at a second side of said membrane switch, wherein said base plate fixing shaft and said base plate fixing hook are penetrated through said first membrane slot; and a second membrane slot arranged at a first side of said membrane switch, wherein said base plate sliding shaft and said base plate sliding hook are penetrated through said second membrane slot.

* * * * *